US007774871B1

(12) United States Patent
Arsenault

(10) Patent No.: US 7,774,871 B1
(45) Date of Patent: Aug. 17, 2010

(54) PERSONAL HYGIENE CLEANSING AND IRRIGATION DEVICE

(76) Inventor: Peter Arsenault, 10 Appleblossom Dr., Dracut, MA (US) 01826

( * ) Notice: Subject to any disclaimer, the term of this patent is extended or adjusted under 35 U.S.C. 154(b) by 889 days.

(21) Appl. No.: 11/652,268

(22) Filed: Jan. 11, 2007

(51) Int. Cl.
*A47K 3/20* (2006.01)

(52) U.S. Cl. ..... 4/568; 4/443; 4/447; 4/567; 4/615

(58) Field of Classification Search ..... 4/443, 4/447, 448, 567–569, 578.1, 579, 611, 615
See application file for complete search history.

(56) References Cited

U.S. PATENT DOCUMENTS 3,528,112 A * 9/1970 Warnick ..... 4/568
4,123,808 A * 11/1978 Guarrera ..... 4/447
5,742,961 A * 4/1998 Casperson et al. ..... 4/615

* cited by examiner

*Primary Examiner*—Tuan N Nguyen
(74) *Attorney, Agent, or Firm*—Joseph E. Funk

(57) ABSTRACT

A personal hygiene cleansing device is disclosed which attaches to the wall of a shower or bath stall and to the water supply at a shower head in the stall. The device is adjustable to meet the height and other personal requirements of the user. Two generally vertically oriented, rubber coated bars are adjusted to a proper height and spacing for a user. When the height and the spacing between the two vertical bars is correct, pushing a users' buttocks against the vertical bars causes the cheeks of the buttocks to be spread exposing the area to a vertical fan shape water spray from a spray head that is part of the device. The rubber piping on the generally vertical bars prevent the bars from slipping along the skin of the buttocks to maintain maximum spreading of the cheeks of the buttocks. Spray water with or without soap exits the elongated spray head to cleanse or rinse the rectal or genital area.

13 Claims, 3 Drawing Sheets

PERSONAL HYGIENE CLEANSING AND IRRIGATION DEVICE

FIELD OF THE INVENTION

This invention relates to personal hygiene and more particularly to washing and personal hygiene cleansing and irrigating devices used in a shower.

BACKGROUND OF THE INVENTION

One of the most widely used personal hygiene devices is known as a shower. Such showers are provided in virtually all bathrooms in private residences, public hotel facilities, health clubs, spas and gymnasiums. While the physical makeup of showers vary somewhat, all typically include a bath tub area, a shower stall or a cubicle within which a supply of water is available. Typically, the force and temperature of the water spray from a fixed or a removable handheld shower head is adjustable by the user to suit their needs. The user adjusts the water spray to their personal preference and stands beneath the spray for washing and rinsing of outer body areas.

Shower facilities typically include an overhead spray source which is usually adjustable as to force and spray pattern. Variations are provided in the form of pulsating sprays for massaging applications or the like. In some shower facilities the shower head is an easily detachable handheld spray head that permits the user to direct the spray to various body areas.

Despite considerable variation of showers, the rectal and genital areas of bathers are often not effectively cleansed. Proper hygiene and sanitation in these body areas is important for overall body health. A variety of ailments and diseases are effectively minimized or eliminated if users properly maintain hygiene in their rectal and genital areas. Conventional fixed shower heads simply do not provide the required spray pattern and direction for proper rectal and genital area hygiene. Handheld sprayers are a definite improvement over fixed shower heads but are most often too large and clumsy and usually fail to allow proper access to rectal and genital areas for maximum cleansing effectiveness. This is most often the case for those with physical limitations such as obesity, arthritis, stroke limitations, post surgical rehabilitation, some senior citizens, persons with mobility and flexibility issues, and other physically limited or handicapped individuals.

Accordingly, there remains a continuing need in the art for improved personal hygiene shower devices which are suited to maintaining and cleansing the rectal and genital areas especially for those with physical limitations and or handicaps.

SUMMARY OF THE INVENTION

The previously described need in the art is satisfied by the present invention. A personal hygiene cleansing and irrigating device used in a shower is provided. The device generally comprises a replacement diverter valve mounted between the water feed pipe to the existing shower head, an extension water hose connected to the diverter that extends downward, and a manually adjustable, vertically elongated spray head attached to the lower end of the extension water hose. The vertically elongated spray head has a spray body having a plurality of spray apertures that provide a vertically elongated, fan shaped water spray pattern that is used for cleansing and irrigating the user's rectal and/or genital area. The vertically orientated spray head may have the ability to articulate in north south/east west directions and also provide pulsating/massaging options.

The lower end of the extension hose is attached to an adjustable frame to which the vertically elongated spray head is also attached. Also attached to the frame are two parallel, spaced, vertically oriented bars between which the elongated spray body is located. The frame is preferably attached to a wall in a bath or shower stall by suction cups as is the extension water hose but may be more permanently attached to the wall. The frame is attached to the wall at roughly the same height as the user's rectal and genital areas. The vertically elongated spray head is adjustably mounted to the frame and may be moved up and down to match the height of the user's rectal and genital areas.

Removably attached to the frame is a liquid soap dispenser in which a liquid soap of choice is inserted by the user and from which soap is mixed with water as it passes through the extension hose to the vertically elongated spray head. Spray exiting the vertically elongated spray head is thereby soapy for the purpose of cleansing the users' rectal or genital areas. There is a valve for regulating the amount or shutting off the flow of soap so that clean water may exit the elongated spray head to cleanse the user's rectal and or genital areas.

There are generally vertically oriented bars covered with rubber or similar material attached to the frame that are adjustable by the user. They are adjusted by the user so that the bars most effectively touch the cheeks of the users' buttocks when the user chooses to do so. The bars are covered by a rubber material (or a material of the like) on the outer surface. The bars also have a slight contour as to better fit the user's anatomy. In utilization of the personal hygiene cleansing device, after the vertically oriented bars are adjusted to proper height and width, and spray water with or without soap is exiting the vertically elongated spray head to clean the rectal area, the user pushes or depresses their buttocks against the rubber vertical bars. When the height and the spacing between the two rubber coated vertical bars is correct, pushing the buttocks against these bars causes the cheeks of the buttocks to be spread exposing the rectal area to a vertical fan shape water spray from the vertically elongated spray head thus exposing the area for proper cleansing and rinsing. The rubber piping on the two generally vertical bars prevent the bars from slipping along the skin of the buttocks for maximum spreading of the cheeks. The vertically orientated rubber bars may also be of different shape or design such as broader, rectangular or other geometric variations maintaining the function to provide a non slip spreading effect when the users buttocks is depressed onto the described.

The use of the vertical bars are not necessary when the user is washing and rinsing their genital area using the personal hygiene cleansing device.

DESCRIPTION OF THE DRAWING

The invention will be better understood upon reading the Detailed Description in conjunction with the drawing in which.

DETAILED DESCRIPTION

Figure 1:
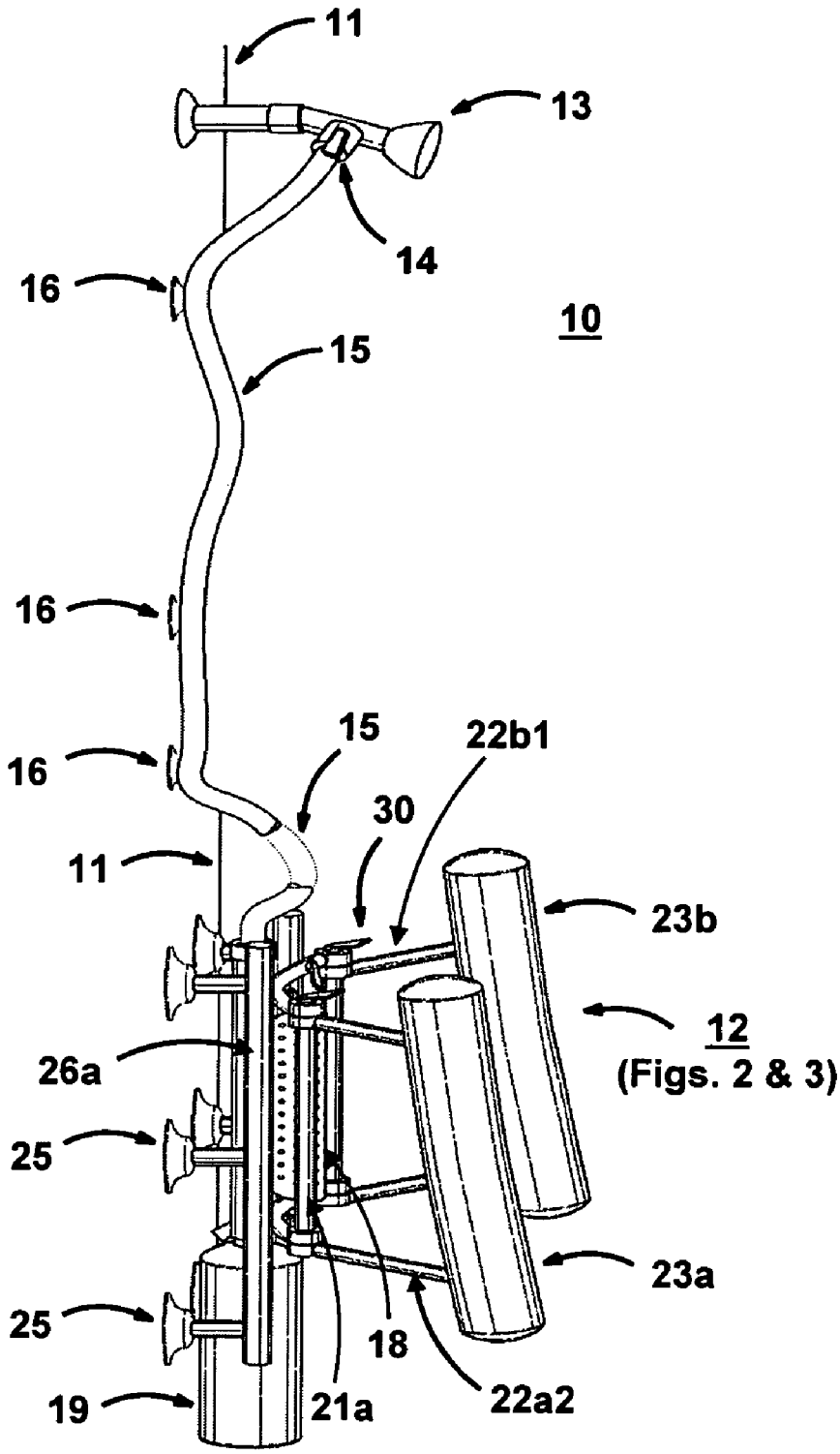
FIG. 1 is a side view of the entire personal hygiene irrigating device.
Figure 2:
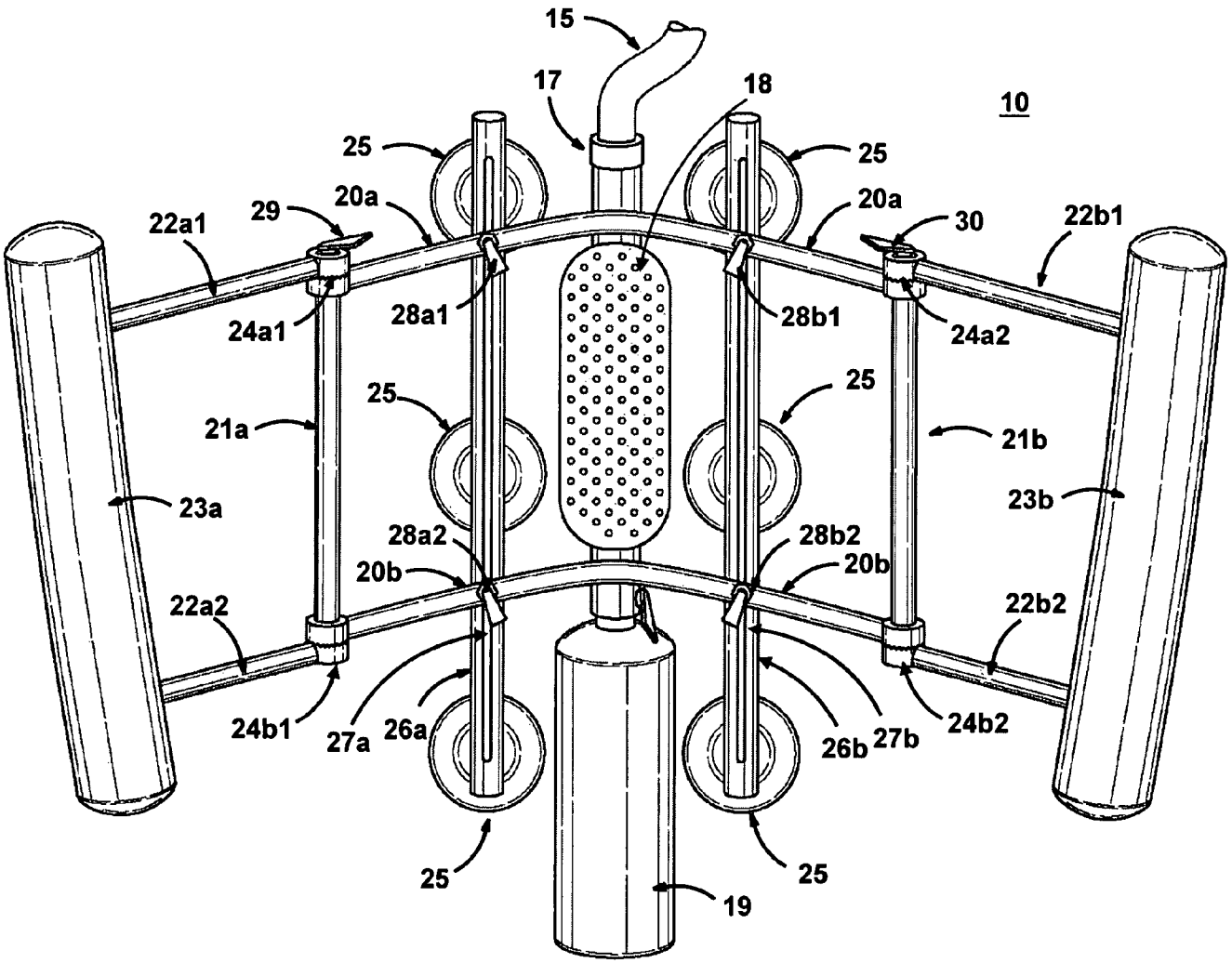
FIG. 2 is a front view of the lower portion of the personal hygiene irrigating device that includes the spray head, the liquid soap dispenser and the two vertically, rubber coated oriented bars.
Figure 3:
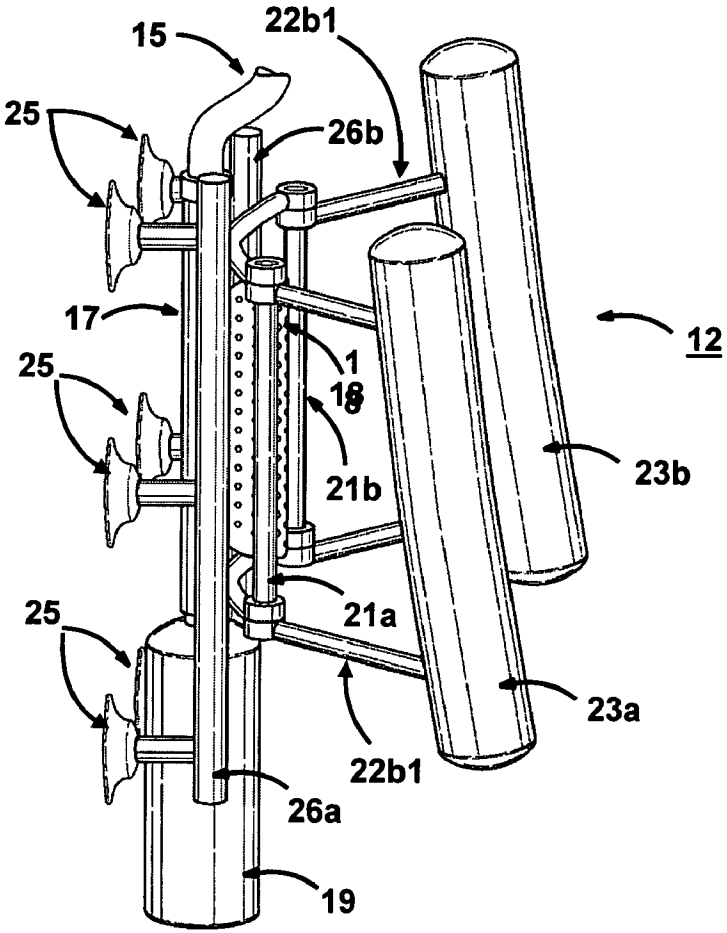
FIG. 3 is a side view of the lower portion of the personal hygiene irrigating device that includes the spray head, the liquid soap dispenser and the two vertically oriented, rubber coated bars.

In FIG. 1 is shown a side view of the entire personal hygiene irrigating device 10. Device 10 comprises three main portions. There is a shower head 13 with replacement water diverter 14. There is a connecting hose 15 and there is a lower assembly 12 that comprises an adjustable frame (17, 20, 21 and 22), a fan shaped spray head 18, and a soap dispenser 19. Elements 17 cannot be see in FIG. 1 but is seen in FIGS. 2 and 3. Elements 20 and 21 are barely seen in FIG. 1 but are shown clearly in FIGS. 2 and 3.

The standard shower head 13 is removed from the water feed pipe and a diverter T junction 14 is attached to the standard water pipe that extends from wall 11 and then the shower head 13 is attached to the outer end of diverter 14. Diverter 14 has a manually operated valve. In one position of the valve all water exits shower head 13, and in a second position all water is diverted through hose 15 to the lower portion 12 of the personal hygiene irrigating device 10. Hose 15 is attached to wall 11 using suction cups 16. Portion 12 is described hereinafter in greater detail with reference to FIGS. 2 and 3.

Lower portion 12 is attached to wall 11 using suction cups 25. Hose 15 is held against wall 11 using suction cups 16. In FIG. 1 hose 15 is shown with an open portion to reflect the vertical scale of device 10. Lower portion 12 is generally positioned before it is attached to wall 11 so that water from spray head 18 will hit the body of a user in the area of their genitals and their rectal area.

Lower portion 12 has an adjustable metal frame (17, 20, 21 and 22) to which the spray head 18 is adjustably fastened so that it may be manually moved upward and downward so that water from spray head 18 will hit the body of different users of different height in the area of their genitals and/or their rectal area when using device 10. This is better seen in FIG. 2.

In FIG. 2 is shown a front view of the lower portion 12 of the personal hygiene irrigating device 10 that includes the spray head 18, the liquid soap dispenser 19 and the two vertically oriented, rubber coated bars 23*a* and 23*b* for spreading the buttocks. All these elements are mounted on a frame, as shown. The frame comprises water feed tube 17, curved bars 20*a* and 20*b*, vertical bars 21*a* and 21*b*, left extension arms 22*a*1 and 22*a*2, right extension arms 22*b*1 and 22*b*2, and vertical adjustment pieces 26*a* and 26*b*.

The frame structure is slidably attached to vertical adjustment pieces 26*a* and 26*b* which are attached to wall 11 using suctions cups 25. As shown in FIG. 2 vertical adjustment pieces 26*a* and 26*b* each respectively have an elongated slot 27 or 27*b* through and along most of their length. The curved bars 20*a* and 20*b* of the frame each have two holes through which a fastening means passes. Fastening means 28*a*1 attaches curved bar 20*a* to vertical adjustment piece 26*a*, and fastening means 28*a*2 attaches curved bar 20*b* to vertical adjustment piece 26*a*. Fastening means 28*b*1 attaches curved bar 20*a* to vertical adjustment piece 26*b*, and fastening means 28*b*2 attaches curved bar 20*b* to vertical adjustment piece 26*b*. When the four aforementioned fastening means are loosened, the frame with the rubber coated bars 23*a* and 23*b* and spray head 18 may be slid up and down to a position that is best for the user of device 10. These fasteners are preferably "L" shaped handles as shown but may be any other type of fastener means.

To this frame are swingably mounted a rubber covered member 23*a* which is attached to left extension arms 22*a*1 and 22*a*2, and a rubber covered member 23*b* which is attached to right extension arms 22*b*1 and 22*b*2. All four extension arms have an end furthest away from bars 23*a* and 23*b* that have a cylindrical end piece. Left extension arm 22*a*1 has a cylindrical end piece 24*a*1 through which vertical bar 21*a* passes, and left extension arm 22*a*2 has a cylindrical end piece 24*b*1 through which vertical bar 21*a* passes. Right extension arm 22*b*1 has a cylindrical end piece 24*a*2 through which vertical bar 21*b* passes, and right extension arm 22*b*2 has a cylindrical end piece 24*b*2 through which vertical bar 21*b* passes. These extension arms each has an adjustment element 29 and 30 that permits rubber coated bars 23*a* and 23*b* to be swung respectively about vertical bars 21*a* and 21*b* to adjust the distance between bars 23*a* and 23*b* to be set for a particular user and then a locking element (grooves on all four cylindrical end pieces) that locks them in this position. As previously described a user sets the horizontal spacing between rubber coated bars 23*a* and 23*b* and their vertical position. When the spacing between the rubber coated bars 23*a* and 23*b* is correct pushing the buttocks against these vertical bars causes the cheeks of the buttocks to be spread exposing the rectal area to a vertical fan shape water spray from elongated spray head 18. The rubber piping or similar material on the vertical bars 23*a* and 23*b* prevent them from slipping along the skin of the buttocks for maximum spreading of the cheeks. The surface of the rubber may have grooves or be roughened to add friction between them and the skin of the buttocks.

When the diverter valve 14 (not shown in FIG. 2) adjacent to shower head 13 (FIG. 1) is manually operated to divert water into hose 15 the water flows into pipe 17 where it passes first over the top of liquid soap container 19 where it picks up some soap by a Venturi effect. An adjustment valve 31 regulates the water flow path to adjust the amount of soap that is picked up. The soapy water then exits the plurality of small holes in spray head 18 to create a vertical, fan shaped, relatively narrow spray pattern that is directed at the rectal or genital area. Alternatively, the soap may be blocked by diverter valve 31 so that none is picked up in the water flow. In that case only plain water is sprayed from spray head 18 to rinse a users' rectal or genital area.

Liquid soap container 19 screws onto the bottom of pipe 17 and is easily and quickly removed to fill or empty container 19.

In FIG. 3 is shown a side view of the lower portion 12 of the personal hygiene irrigating device 10 that includes the spray head 18, the liquid soap dispenser 19 and the two vertically oriented, rubber coated bars 23*a* and 23*b*. The elements are connected and function together and individually as described with reference to FIG. 2 so the description is not repeated. FIG. 3 shows the suction cups 25 that mount lower portion 12 to wall 11 of a shower. It can seen in this Figure that rubber coated bars 23*a* and 23*b* are spaced furthest from the shower wall than any other elements, and that the lower end of the bars are spaced further from the wall the top of the same bars.

While what has been described hereinabove is the preferred embodiment of the invention, it will be apparent to those skilled in the art that numerous changes may be made without departing from the spirit and scope of the invention.

The invention claimed is:

1. A personal hygiene cleansing device for use in a bath or shower stall to clean a user's rectal area or genital area, the device comprising:

means for coupling the device to a supply of water;

a water conduit having a first and a second end and the first end is connected to said coupling means;

a frame fastened to the wall of the bath or shower stall, the frame having two generally vertically oriented, spaced bars attached thereto that are spaced from the wall;

a spray head attached to the frame and to the second end of the water conduit for directing a water spray away from the wall of the bath or shower stall, the water spray used for cleaning either the user's rectal area or genital area, the spray head being closer to the wall than the spaced bars and the water spray from the spray head passes between the two spaced vertically oriented bars;

wherein the user of the device presses their buttocks against the two spaced vertically oriented bars, with one of the two cheeks of the buttocks touching each bar, and the user's cheeks are spread as they press their buttocks against the bars to facilitate cleaning the rectal area.

2. The personal hygiene cleansing device of claim 1 wherein the two spaced generally vertically oriented bars are adjustable and the user may manually adjust both their height and their spacing to best fit and facilitate spreading of the cheeks of the user's buttocks when they press their buttocks against the bars.

3. The personal hygiene cleansing device of claim 2 further comprising a container of soap that is connected between the second end of the water conduit and the spray head, and water passing through the water conduit to the spray head picks up soap from the soap container.

4. The personal hygiene cleansing device of claim 3 further comprising first shut off means for stopping and regulating the soap flow from the soap container and mixing with water flowing from the water conduit to the spray head so that soapy water or clean water may spray from the spray head for cleaning or rinsing the user's rectal area or genital area.

5. The personal hygiene cleansing device of claim 4 wherein the water supply coupling means is adjacent a shower head and comprises second shut off means that is operated by the user to selectively pass water to the shower head or through the water conduit to the spray head.

6. The personal hygiene cleansing device of claim 5 wherein the two spaced, generally vertically oriented bars have a coating that provides friction against the cheeks of the user's buttocks to facilitate spreading the cheeks when the user presses their buttocks against the bars.

7. The personal hygiene cleansing device of claim 1 further comprising first shut off means for stopping and regulating the soap flow from the soap container and mixing with water flowing from the water conduit to the spray head so that soapy water or clean water may spray from the spray head for cleaning or rinsing the user's rectal area or genital area.

8. The personal hygiene cleansing device of claim 7 further comprising a container of soap that is connected between the second end of the water conduit and the spray head, and water passing through the water conduit to the spray head picks up soap from the soap container.

9. The personal hygiene cleansing device of claim 1 further comprising first shut off means for stopping and regulating the soap flow from the soap container and mixing with water flowing from the water conduit to the spray head so that soapy water or clean water may spray from the spray head for cleaning or rinsing the user's rectal area or genital area.

10. The personal hygiene cleansing device of claim 1 wherein the water supply coupling means is adjacent a shower head and comprises second shut off means that is operated by the user to selectively pass water to the shower head or through the water conduit to the spray head.

11. The personal hygiene cleansing device of claim 10 wherein the two spaced, generally vertically oriented bars have a coating that provides friction against the cheeks of the user's buttocks to facilitate spreading the cheeks when the user presses their buttocks against the bars.

12. The personal hygiene cleansing device of claim 1 wherein the two spaced, generally vertically oriented bars have a coating that provides friction against the cheeks of the user's buttocks to facilitate spreading the cheeks when the user presses their buttocks against the bars.

13. The personal hygiene cleansing device of claim 12 further comprising a container of soap that is connected between the second end of the water conduit and the spray head, and water passing through the water conduit to the spray head picks up soap from the soap container.

* * * * *